US006106230A

United States Patent [19]

Burgess

[11] Patent Number: 6,106,230

[45] Date of Patent: Aug. 22, 2000

[54] CENTRIFUGAL PUMP

[75] Inventor: Kevin Edward Burgess, Artarmon, Australia

[73] Assignee: Warman International Limited, Artarmon, Australia

[21] Appl. No.: 09/091,256

[22] PCT Filed: Nov. 14, 1996

[86] PCT No.: PCT/AU96/00734

§ 371 Date: Sep. 29, 1998

§ 102(e) Date: Sep. 29, 1998

[87] PCT Pub. No.: WO97/21927

PCT Pub. Date: Jun. 19, 1997

[30] Foreign Application Priority Data

Dec. 14, 1995 [AU] Australia ..... PN 7155

[51] Int. Cl.[7] ..... F01D 9/00

[52] U.S. Cl. ..... 415/196; 415/206; 415/214.1; 416/186 R; 416/189; 416/223 B; 416/237

[58] Field of Search ..... 415/206, 196, 415/197, 214; 416/185, 186 R, 244 R, 188, 189, 223 B, 237, 235; 29/888.21, 888.24, 401.1

[56] References Cited

U.S. PATENT DOCUMENTS

| | | | |
|---|---|---|---|
| 3,316,848 | 5/1967 | Egger | 415/206 |
| 4,752,187 | 6/1988 | Hergt et al. | 416/186 R |
| 4,923,369 | 5/1990 | Addie et al. | 415/206 |
| 5,797,724 | 8/1998 | Liu et al. | 415/206 |

*Primary Examiner*—Edward K. Look
*Assistant Examiner*—Ninh Nguyen

[57] ABSTRACT

An impeller for a centrifugal pump which includes a front shroud and a rear should, the shoulds being spaced apart so as to form a plurality of passageways therebetween which are separated by a plurality of impeller blades. The impeller has an outer diameter $D_2$ and an inlet diameter $D_1$. Each passageway has an inlet portion with a passage outlet $B_2$, and an intermediates portion between the inlet and outlet portions. In the inlet portion the front shroud is curve away from the rear shroud so that the passageway outlet width $B_2$ is less than the passageway inlet width $B_1$. A method of increasing the Best Efficiency Point Flow rate comprises providing such an impeller and also providing a new front liner or throat bush which has an inner wall which is complementary to the wall of the inlet portion of the impeller while retaining the same main liner or casing section.

5 Claims, 3 Drawing Sheets

CENTRIFUGAL PUMP

This invention relates to centrifugal pumps and more particularly, but not exclusively to slurry pumps.

BACKGROUND OF THE INVENTION

The invention is particularly applicable to centrifugal pumps having an internal liner although reference to this particular application is not to be taken as a limitation to the scope of the invention. It will be readily apparent to those persons skilled in the art that the invention is also applicable to pumps which do not have an internal lining.

FIG. 1 is a schematic sectional side elevation of part of a typical centrifugal slurry pump currently in use. The pump generally indicated at 10 comprises an elastomeric liner 11 which is mounted within a rigid housing (not shown). The liner 11 includes a main liner 12 and a front liner 13 (often referred to as a throat bush). The main liner may be formed of two parts. Such is well known in the art and it is not proposed to discuss it in detail here.

The pump 10 further includes an impeller 15 comprising a front shroud 16 and rear shroud 17. A series of passageways 18 are formed between the shrouds these passages being separated from one another by blades or vanes 19. The pump 10 has an inlet 20 and each passage has a passageway inlet 21 and a passageway outlet 22. The pump inlet 20 is shown as having a diameter $D_1$, the passageway inlet 21 is shown as having a width $B_1$ and the passageway outlet is shown as having a width $B_2$. The outer diameter of the impeller is shown as $D_2$.

All centrifugal pumps have a flowrate at which their efficiency is at a maximum. This is called the Best Efficiency Point (BEP) flowrate.

FIG. 2 is a graph for a typical centrifugal pump plotting the head (or pressure) of the pump against flow rate. The BEP flowrate is that when the graph reaches its highest point.

At lower or higher flows, the efficiency is less than at the BEP point. The BEP flowrate is determined by the pumps geometry. The most practical and cost effective method of producing pumps is to design pumps with a fixed geometry to suit a particular duty. Normally the pumps BEP flowrate will be made to coincide as close as possible to the required or duty flowrate in order to achieve the most economical operation.

Once a pump's geometry is fixed, then the BEP flowrate can only be changed to a small degree. The design and manufacture of variable geometry centrifugal slurry pumps is not economical. Changing the internal liner shape of the configuration of the impeller is possible in order to make small changes to the BEP flowrate. However, such changes are expensive as patterns and molds require alteration to change the geometry. This particularly applies to the pump liners.

In some instances, the required or duty flowrate specified by a customer is higher than the BEP flowrate for the available fixed geometry pumps. In this case the efficiency will be lower than optimum and would result in higher running costs. This situation might arise if the duty flowrate is higher than the largest pump available, or the duty flowrate fell between two fixed pump models. In both cases it is logical to increase the BEP flowrate of the smaller pump if the increase required is in the order of up to 35% higher.

The BEP flowrate is determined amongst other parameters by the width of the pump liners and the impeller. To increase the BEP flowrate, the impeller needs to be made wider. As it is not practical or economical to change the main pump liners, the outlet width of the impeller cannot be increased.

Typically it will only be the flowrate that needs to be increased and the head (pressure) and speed of the pump would remain approximately the same. Increasing only the pump flowrate, increases a pumps specific speed. This is a non-dimensional number incorporating the pump flowrate, head and speed and is universally applied to characterize a pump's design. The specific speed and hence the pump head can be improved by changing the design of the impeller.

Typically in currently known centrifugal pumps the widths of the passageway inlet and outlet are approximately the same. Furthermore the inclination angle $\beta$ as shown in FIG. 1 is in the range from 0 to 15°.

The inclination angle is defined as the angle between a line joining the mid points of the passageway inlet and outlet widths to a line at right angles through the passageway outlet width.

SUMMARY OF THE INVENTION

It is an object of the present invention to provide an improved pump which has the same impeller diameter ($D_2$) and passageway outlet width ($B_2$) which has an increased flowrate at its BEP relative to a currently known radial flow pump.

It is another object of the present invention to provide an improved impeller for use in a pump according to the present invention.

According to one aspect of the present invention there is provided an impeller for a centrifugal pump which includes a front shroud and a rear shroud the shrouds being spaced apart so as to form a plurality of passageways therebetween which are separated by a plurality of impeller blades the impeller having an outer diameter $D_2$ and an inlet diameter $D_1$, each passageway having an inlet portion with a passageway inlet having a width $B_1$ an inlet portion having a passageway outlet $B_2$ and an intermediate portion between the inlet and outlet portions; characterized in that in the inlet portion the front shroud is curved away from the rear shroud so that the passageway outlet width $B_2$ is less than the passageway inlet width $B_1$.

Preferably, the passageway angle (B) (as herein defined, is in the range from 10° to 35°. In one preferred arrangement the passageway angle is about 20°.

Preferably the ratio of $D_2/D_1$ is from 1.5 to 3 and the ratio $B_1/B_2$ is from 1.1 to 1.6.

According to another aspect of the present invention there is provided a pump having a casing with or without main liner and front liner and an impeller as described above.

By the above arrangement the width of the impeller at its passageway inlet can be increased without affecting the main liner or casing. Modification is only required of the front liner or throat bush. These modifications are much cheaper than having to modify the main liner or casing. By modifying the impeller as described above has the effect of increasing the BEP flowrate and increasing the pump's specific flowrate.

DESCRIPTION OF THE PREFERRED EMBODIMENT

Figure 1:
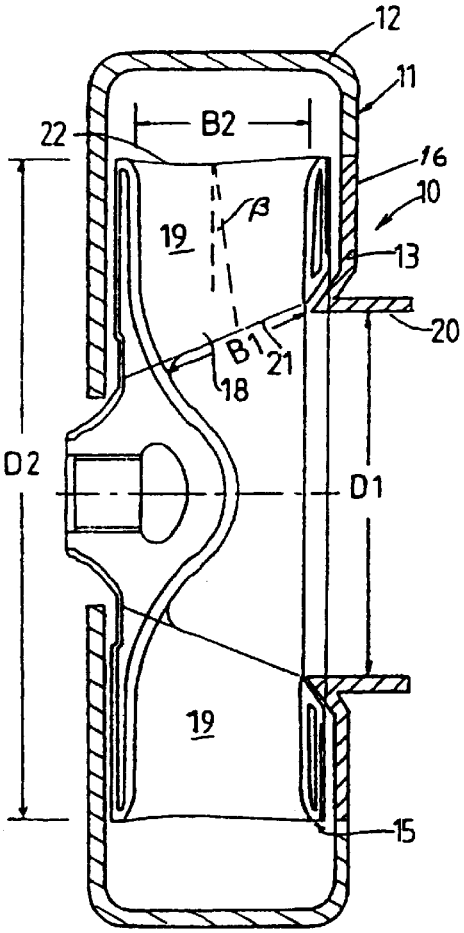
FIGURE 1 (PRIOR ART)
FIG. 1, already described, is a schematic sectional side elevation of a known centrifugal slurry pump.
Figure 2:
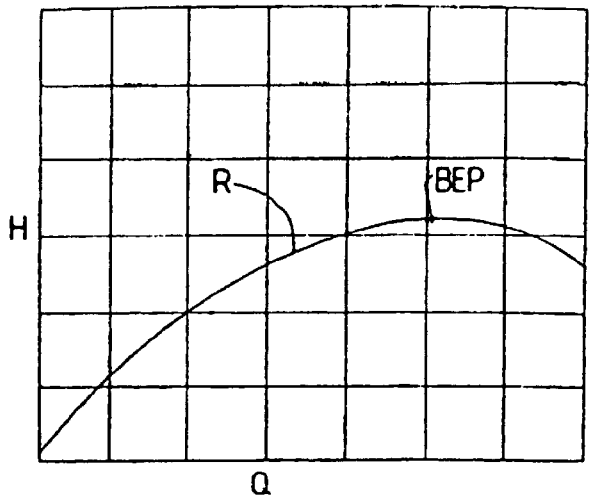
FIGURE 2 (PRIOR ART)
FIG. 2, already disclosed, is a graph for a known pump plotting pump head against flow rate.
Figure 3:
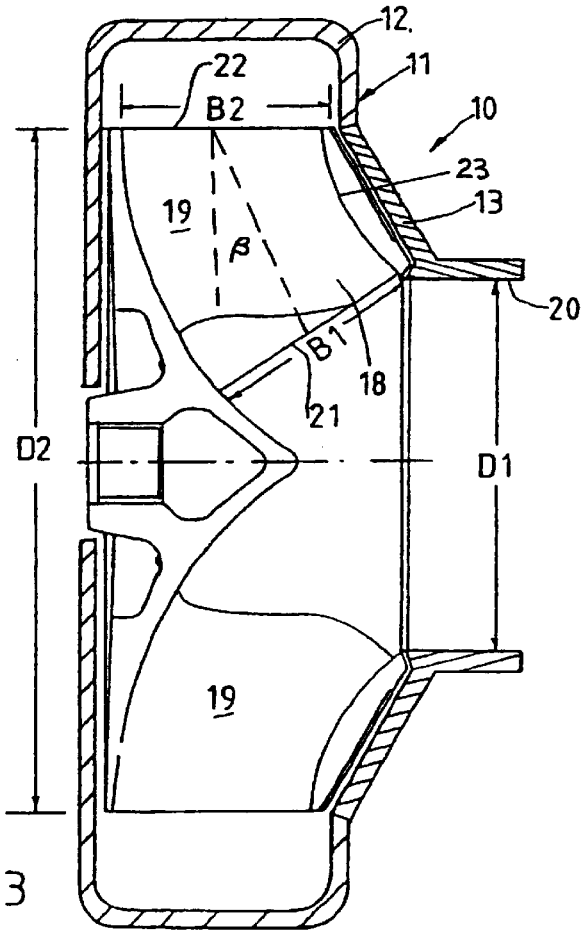
FIG. 3, is a view similar to FIG. 1 of a pump according to the invention.

An example embodiment of pump according to the present invention is shown in FIG. 3 where like reference numerals have been used to describe like parts as shown in FIG. 1.

As shown in FIG. 3, the pump 10 has an impeller 15 which includes passageways 18 which include an inlet portion 21, an outlet portion 22 and an intermediate portion 23. The walls of the passageways form a continuous smooth curve from the outlet portion to the inlet portion. As can be seen the width $B_1$ of the inlet is greater than the width $B_2$ of the outlet and the angle β is greater than that of the currently known pump shown in FIG. 1.

Design practicalities of slurry pumps, generally dictate that the width of the impeller at the inlet and the outlet is approximately the same (i.e. $B_1=B_2$) in FIG. 1. The inclination angle β for a normal radial design of slurry pumps is 0 to 15°. The angle β is defined as shown in FIGS. 1 and 3 as the angle between a line joining the mid points of the inlet and outlet widths to a vertical line through the outlet width mid point. The inlet width ($B_1$) is sometimes increased in normal practice to improve the pumps cavitation performance. Ratios of inlet to outlet width ($B_1/B_2$) could typically vary from 1.0 to 1.15.

If the inlet is "stretched", then the inlet to outlet width ratio ($B_1/B_2$) can be increased and the angle β of the passageway can be increased. There is an optimum ratio at which the increased BEP flowrate is achieved beyond which there is a diminishing increase in BEP flowrate. The casing design can also affect the final result. A large width ratio would be $B_1/B_2$=1.1 to 1.6. The angle β would vary between 10 and 35° with an optimum angel around 20° for a $D_2/D_1$ ratio of 2 to 2.5. As the $D_2/D_1$ ratio becomes larger, the practicality of stretching the inlet would become less and the lower the angle that β that could be achieved.

The impeller vane design must also be in line with a mixed flow type pump and to match the new higher flowrate. The front liner and casing half of the pump would also be changed as necessary to match te new angle of the impeller.

While the method is economical for lined slurry pumps, the same principles could be applied to unlined pumps.

EXAMPLE

A comparative test was done between a conventional pump having an impeller of the type shown in FIG. 1 with a pump having an impeller of the type shown in FIG. 3. Relevant parameters of each pump are set out below

| | Conventional Pump | Modified Pump |
|---|---|---|
| $D_2$ | 1425 | 1435 |
| $D_1$ | 625 | 690 |
| $B_1$ | 325 | 470 |
| $B_2$ | 325 | 408 |

Figure 4:
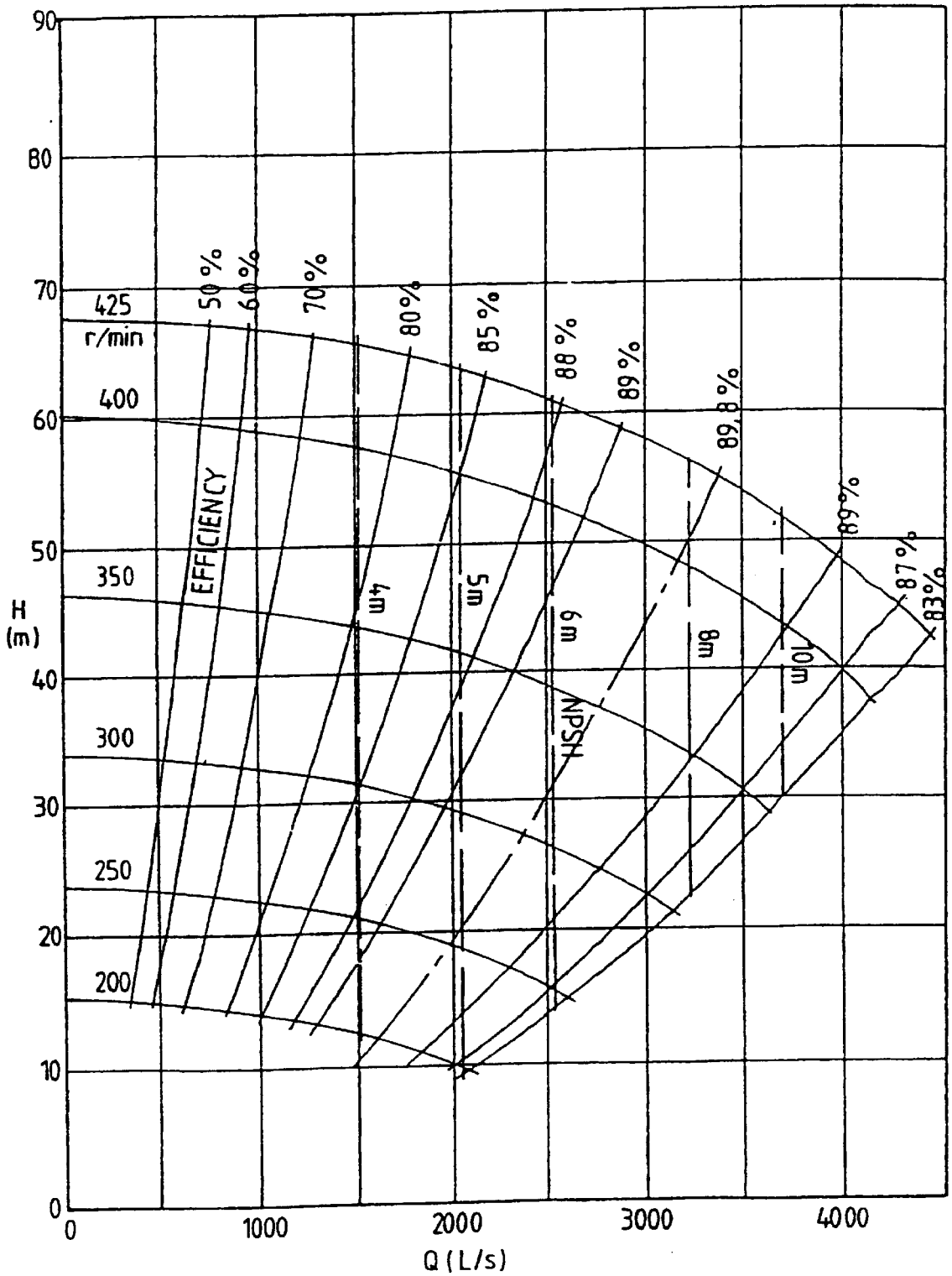
FIGS. 4 and 5 show plots of the head or lift of the FIG. 3 pump against flow rate.
Figure 5:
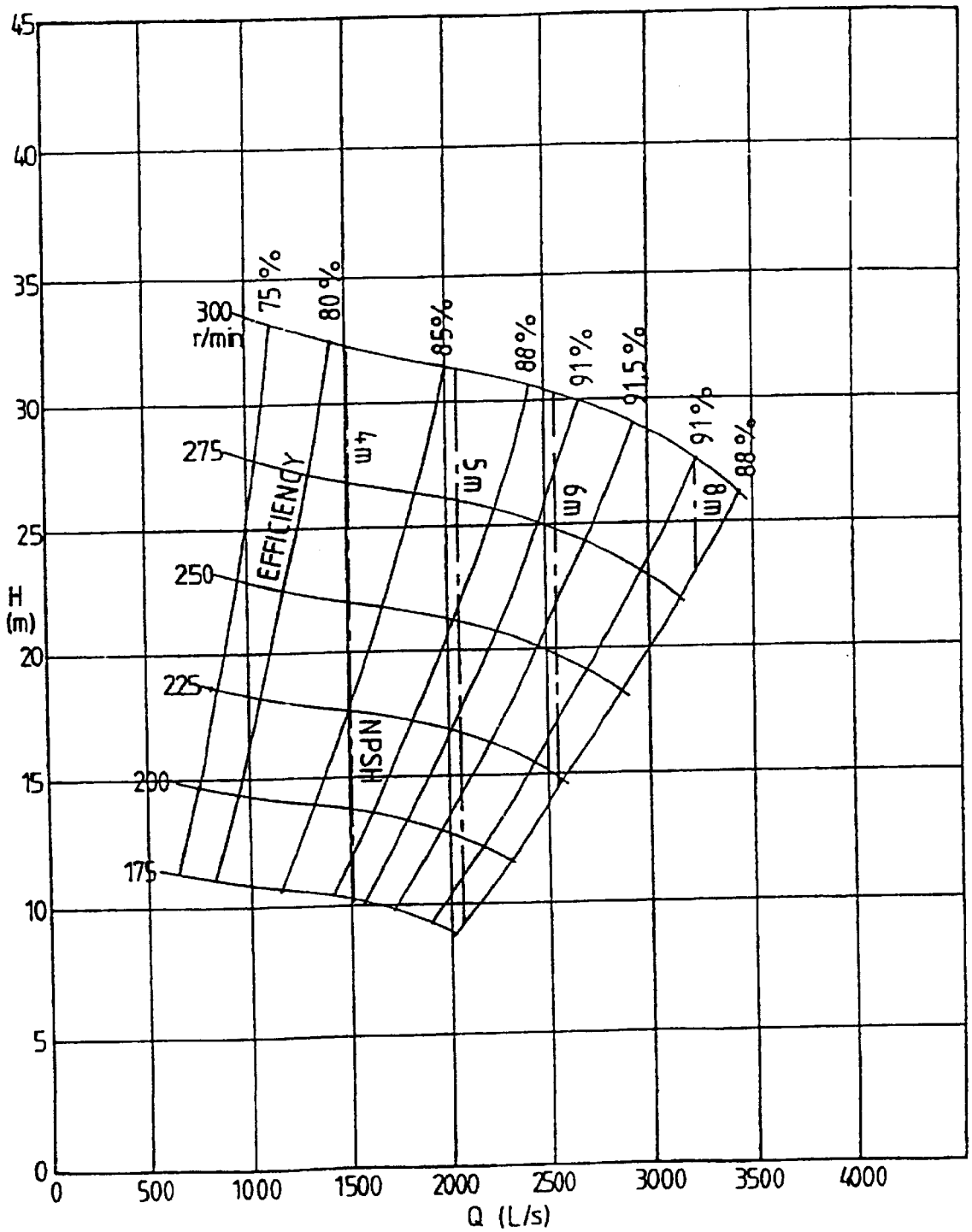

FIGS. 4 and 5 show plots of head (lift) against flow rate.

It can be seen that at the best efficiency (BEP) for each pump the modified pump at a head of 25 meters has significantly increased flow rate compared to that of the conventional pump at the same head.

Finally, it is to be understood that various alterations, modifications and/or additions may be incorporated into the various constructions and arrangements of parts without departing from the spirit or ambit of the invention.

What is claimed is:

1. A method of increasing the flow rate at BEP for a radial flow pump of selected parameters said pump including a main casing and a front casing or throat bush having an inlet diameter $D_1$ and an impeller having an outer impeller diameter $D_2$ and an inlet diameter substantially the same as the inlet diameter of the front casing or throat bush, the method including the steps of:

(a) replacing the impeller with a modified impeller, said modified impeller including a front shroud and a rear shroud the shrouds being spaced apart so as to form a plurality of passageways therebetween which are separated by a plurality of impeller blades the impeller having an outer diameter $D_2$ and an inlet diameter $D_1$, each passageway having an inlet portion with a passageway inlet having a width $B_1$ an outlet portion having a passageway outlet $B_2$ and an intermediate portion between the inlet and outlet portions; in the inlet portion the front shroud being curved away from the rear shroud at a passageway angle β so that the passageway outlet width $B_2$ is less than the passageway inlet width $B_1$; and (b) replacing the front casing or throat bush with a modified front casing or throat bush having an inner wall which is complementary to the wall of the front shroud of the modified impeller while retaining the same main casing.

2. A method according to claim 1 wherein the passageway angle β is in the range from 10° to 35°.

3. A method according to claim 2 wherein the passageway angle is about 20°.

4. A method according to any one of claims 1 to 3 wherein the ratio of $D_2/D_1$ is from 1.5 to 3.0.

5. A method according to any one of claims 1 to 3 wherein the ratio $B_1/B_2$ is from 1.1 to 1.6.

* * * * *